US009988168B1

(12) United States Patent
Sutter

(10) Patent No.: US 9,988,168 B1
(45) Date of Patent: Jun. 5, 2018

(54) TAPE SEALER

(71) Applicant: Michael Wayne Sutter, Eagleville, TN (US)

(72) Inventor: Michael Wayne Sutter, Eagleville, TN (US)

( * ) Notice: Subject to any disclaimer, the term of this patent is extended or adjusted under 35 U.S.C. 154(b) by 328 days.

(21) Appl. No.: 14/958,470

(22) Filed: Dec. 3, 2015

(51) Int. Cl.
*B65B 51/06* (2006.01)
*B65H 35/00* (2006.01)

(52) U.S. Cl.
CPC ..... *B65B 51/06* (2013.01); *B65H 35/008* (2013.01); *B65H 35/0013* (2013.01)

(58) Field of Classification Search
CPC ... B65B 51/06; B65B 51/065; B65H 35/0013; B65H 35/008
See application file for complete search history.

(56) References Cited

U.S. PATENT DOCUMENTS 2,841,935 A * 7/1958 Krueger ..... B65B 67/06 53/139.1
2,909,019 A * 10/1959 MacBride ..... B65C 3/02 156/DIG. 6
2,916,863 A * 12/1959 Leighton ..... B65B 67/06 53/139.1
3,141,277 A * 7/1964 Johnston ..... B65B 67/06 53/137.2
3,197,938 A * 8/1965 Lasoff ..... B65B 51/04 264/238
3,729,896 A 5/1973 Lehmann
RE28,170 E 9/1974 Lehann
3,922,834 A * 12/1975 Clayton ..... B65B 7/02 53/139.1
4,242,171 A * 12/1980 Kauer ..... B65B 67/06 156/485
4,537,005 A * 8/1985 Hoyland ..... B65B 51/065 53/131.5
4,545,185 A * 10/1985 Chikatani ..... B65B 51/065 53/412
4,718,220 A * 1/1988 Van Rosendal ..... B65B 67/06 53/137.2
4,721,545 A 1/1988 Santorineos
5,295,345 A * 3/1994 Ter Haar ..... B65B 67/06 53/136.5
5,600,934 A 2/1997 Van Rosendal
5,992,128 A 11/1999 Langerak
8,739,500 B2 * 6/2014 Yu Chen ..... B65B 7/02 30/278
2006/0113043 A1 6/2006 Imazeki

* cited by examiner

*Primary Examiner* — Linda L Gray
(74) *Attorney, Agent, or Firm* — Quickpatents, LLC; Kevin Prince

(57) ABSTRACT

An apparatus for sealing an object, such as a bag, with a one-sided adhesive tape includes a rigid base fixed with a rear plate that has a tape roll spindle rotationally attached thereto. A front plate is fixed with the rear plate with at least one standoff, defining a gap therebetween for holding a sealing mechanism. The front and rear plates each include a sealing pathway traversing a top side of each plate and terminating at an orthogonally-oriented cutting pathway. The sealing mechanism comprises an indexing wheel, a tape brake having a tape engaging surface urged against the indexing wheel, and a tape cutter having a cutting blade fixed with an upper end thereof. An object cutter includes a blade for cutting the object when the object is moved through the cutting pathway.

14 Claims, 5 Drawing Sheets

TAPE SEALER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to sealing machines, and more particularly to a bag sealing machine.

DISCUSSION OF RELATED ART

Manual sealing of objects such as bags that contain food or other items is typically done with a tape sealing machine, such as those disclosed in any of the following prior art references:

| Pat./Pub. No. | Publication Date | Inventor |
|---|---|---|
| 2006/0113043 | Jun. 1, 2006 | Imazeki |
| 3,729,896 | May 1, 1973 | Lehmann |
| 4,721,545 | Jan. 26, 1988 | Santorineos |
| 5,600,934 | Feb. 11, 1997 | van Rosendal et al. |
| RE 28,170 | Sep. 24, 1974 | Lehmann |

With such prior art devices, an indexing wheel rotates as the object is pushed through a sealing path, which causes a length of adhesive tape to loop around the object and seal the object before being cut with a tape cutter. Optionally a second cutting blade trims the top adjacent the tape seal.

With all such prior art devices, failure of any one of the mechanisms or components within results in a complicated process for replacement and significant down time of the machine. Further, such prior art devices make no accommodation for adjusting the angle of the device on a support surface based on the height and comfort of the user, nor do they easily accommodate both left and right-handed users. Such prior art inventions often fail in proper tape cutting due to quickly-dulled cutting blades being forced into another element of the cutting mechanism, and provide no means for servicing the cutting mechanism while in the area of service.

Therefore, there is a need for a device that is field-serviceable, wherein each component of the device is modular and easily replaced. Further, such an invention would provide means for storing spare parts and tools for facilitating field servicing. Such a needed device would include an independent tape brake with positive indexing wheel engagement, reducing wear on the cutting blade and producing more consistent tape cuts. Further, such a device would be adjustable by the user for differing user heights and for users who are either left or right-handed. The present invention accomplishes these objectives.

SUMMARY OF THE INVENTION

The present device is an apparatus for sealing an object, such as a bag, with a one-sided adhesive tape while the apparatus rests on a support surface. Typically the bag contains food or other items, and the top of the bag is twisted before inserting into the apparatus for sealing with the tape and subsequent cutting of the tape and, optionally, the top of the bag.

A rigid base is adapted for fixing with the support surface. A rigid rear plate is cooperative with the base to provide pivotal movement between the rear plate and the base and to rotationally lock the rear plate to the base at a desired angle for the user.

The rear plate further includes a tape roll spindle rotationally attached to the rear plate. The rear plate further includes a sealing pathway traversing a top side of the rear plate and terminating at an orthogonally-oriented cutting pathway of the rear plate. A similar front plate is fixed with the rear plate with at least one standoff, thereby defining a gap therebetween for holding a sealing mechanism. The front plate also includes the sealing pathway aligned with the sealing pathway of the rear plate and traversing a top side of the front plate and likewise terminating at an orthogonally-oriented cutting pathway of the front plate. In one embodiment the at least one standoff between the front and rear plates defines at least one spare parts storage volume.

The sealing mechanism comprises an indexing wheel rotationally captured between the front and rear plates and having a tape engaging surface urged against the indexing wheel adjacent the sealing pathway with a first biasing mechanism, such as a coil spring fixed between the tape brake and the rear plate or a first mounting post fixed between the front and rear plates. A tape cutter is rotationally captured between the front and rear plates at a central position thereof and has a lower end and a cutting blade fixed with an upper end thereof. A second biasing mechanism urges the blade away from the sealing pathway and the lower end across the sealing pathway.

An object cutter is fixable to either the front or rear plate at the cutting pathway thereof, preferably with a plurality of mechanical fasteners, such that both right-handed and left-handed users may configure the apparatus for their use. The object cutter includes a blade for cutting the object when the object is moved through the cutting pathway.

In use, with the tape fixed with the tape roll spindle and a length of the tape fixed along a top side of the indexing wheel and across the sealing path, the object when forced down through the sealing path receives the length of tape between two of the teeth of the indexing wheel. The tape brake captures a leading edge of the tape to adhere to a loop of the tape as the object passes the tape brake. Preferably the tape brake, when urged into contact with the indexing wheel, spans the gap between two adjacent teeth of the indexing wheel, such that the cut end of the tape is attached to the tape brake. The object is then sealed by the loop of the tape adhering to itself and passing along the tape cutter that, when the object contacts the lower end of the tape cutter, rotates to force the tape cutting blade across the sealing pathway to cut the tape. The object is then moved through the cutting pathway to cut the object with the blade of the object cutter.

In one embodiment, a tape alignment wheel is rotationally fixed between the front and rear plates between the indexing wheel and the tape roll spindle. The tape alignment wheel is adapted for receiving partially therearound a length of the tape as it is removed from the tape roll spindle and wrapped partially around the indexing wheel.

The present invention is field-serviceable, each main component thereof being modular and easily replaced while in the environment of use of the apparatus. Further, the present invention provides means for storing spare parts and tools for facilitating field servicing. The present apparatus includes an independent tape brake with positive indexing wheel engagement, reducing wear on the cutting blade and producing more consistent tape cuts. Further, the device is adjustable by the user for differing user heights and for users who are either left or right-handed. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
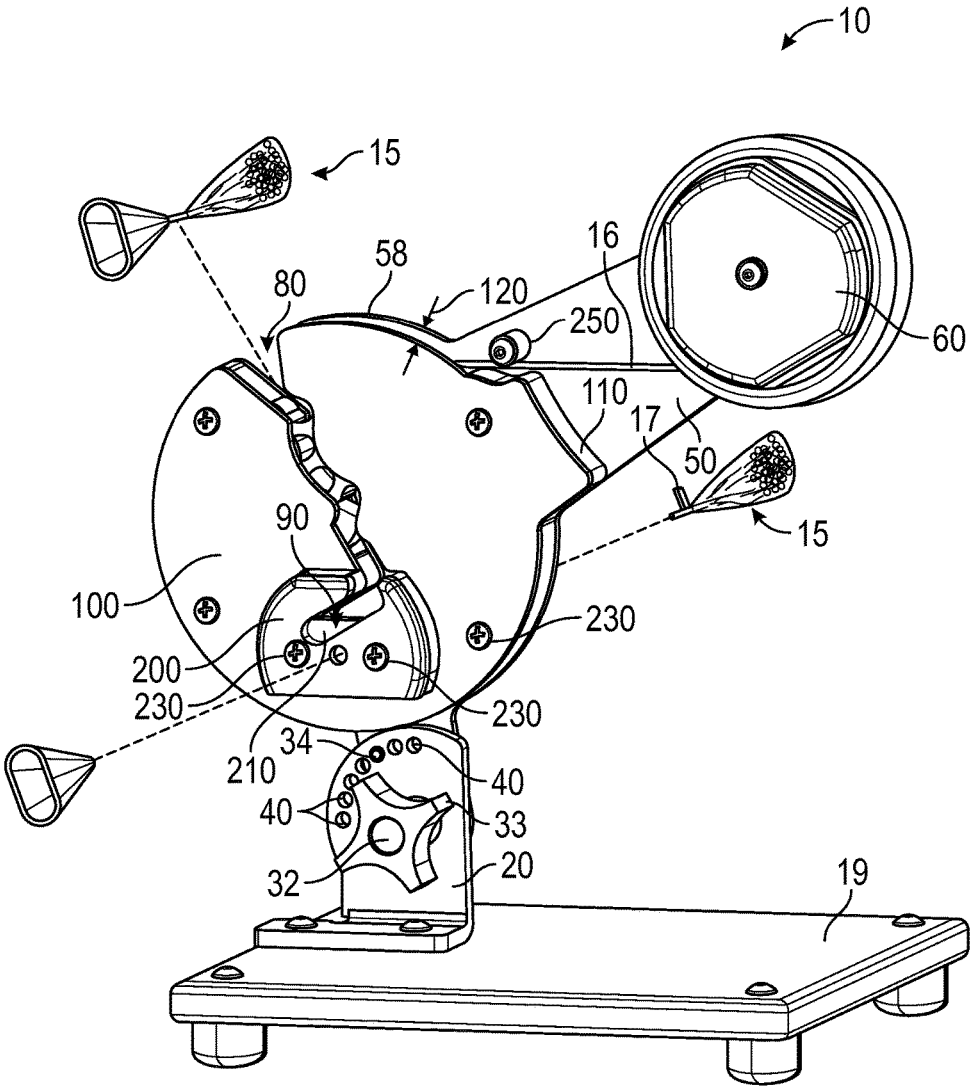
FIG. 1 is a left-side perspective view of the invention.
Figure 2:
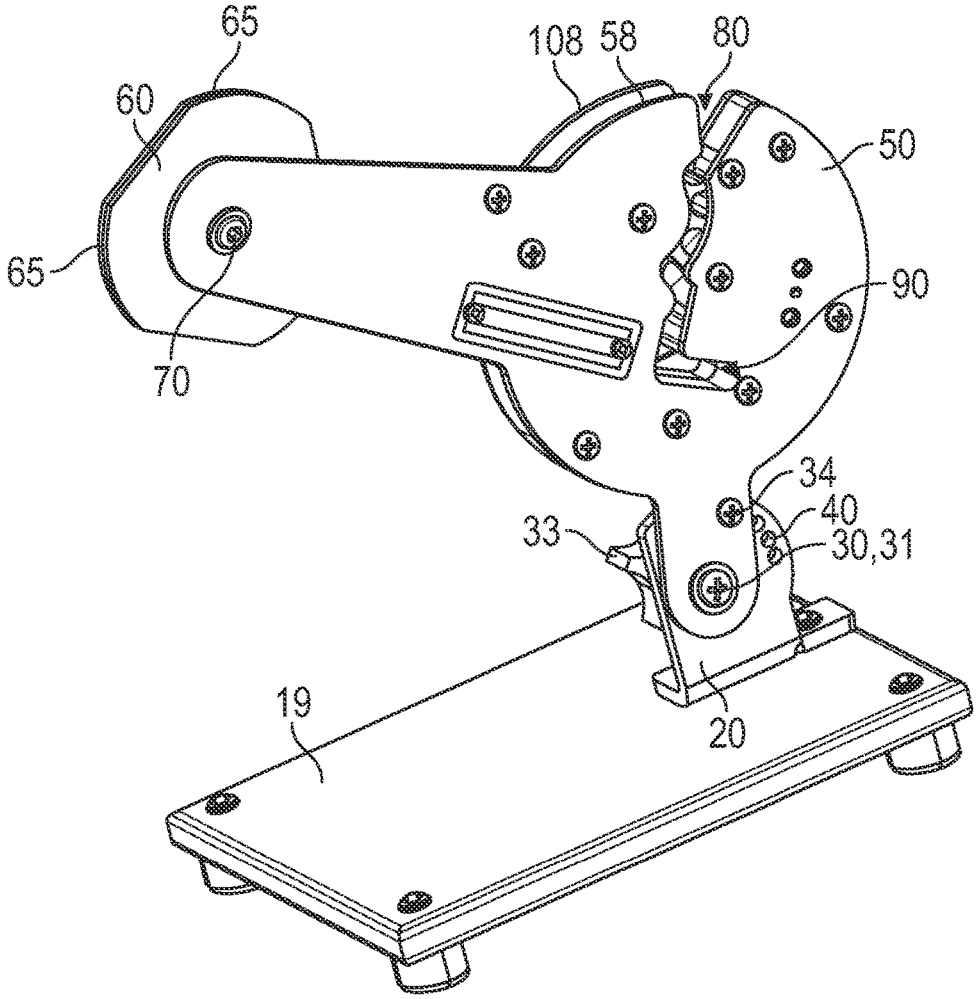
FIG. 2 is a right-side perspective view of the invention.
Figure 3:
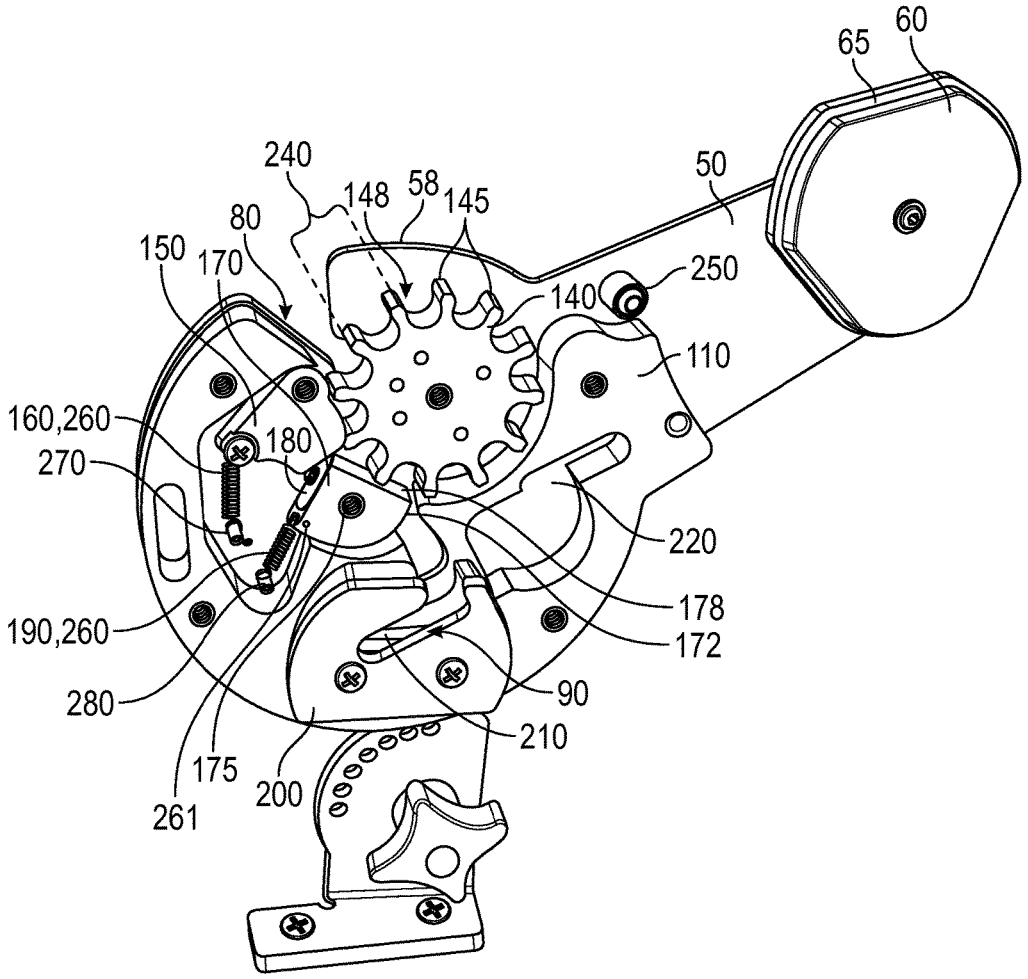
FIG. 3 is a left-side perspective view of the invention, illustrated with an enclosure cover omitted for clarity of illustration.

FIGS. 1-3 illustrate an apparatus 10 for sealing an object 15, such as a bag, with a one-sided adhesive tape 16 while the apparatus 10 rests on a support surface 19. Typically the bag 15 contains food or other items (not shown), and the top of the bag 15 is twisted before inserting into the apparatus 10 for sealing with the tape 16 and subsequent cutting of the tape 16 and, optionally, the top of the bag 15.

A rigid base 20 is adapted for fixing with the support surface 19 and includes a pivot aperture 30 and a plurality of radially-spaced angle adjustment apertures 40. A rigid rear plate 50 has a second pivot aperture 31 cooperative with a pivot pin 32 and the pivot aperture 30 of the base 20 to provide pivotal movement between the rear plate 50 and the base 20. The rear plate 50 further includes an adjustment pin 34 adapted for engaging any of the angle adjustment apertures 40 of the base 20, a manual adjustment knob 33 cooperative with the pivot pin 32 to tighten the rear plate 50 to the base 20 with the adjustment pin 34 engaged with one of the angle adjustment apertures 40 to rotationally lock the rear plate 50 to the base 20. Preferably the base 20 and the rear plate 50 are made from a strong metallic sheet material, but could also be made from a strong, rigid plastic or wood material.

The rear plate 50 further includes a tape roll spindle 60 rotationally attached at a tape role aperture 70 traversing the rear plate 50. The tape reel spindle 60 preferably further includes a tape reel ledge 65 adapted to align the tape 16 with the indexing wheel 140 as the tape 16 is removed from the tape reel spindle 60. The rear plate 50 further includes a sealing pathway 80 traversing a top side 58 of the rear plate 50 and terminating at an orthogonally-oriented cutting pathway 90 of the rear plate 50.

Figure 4:
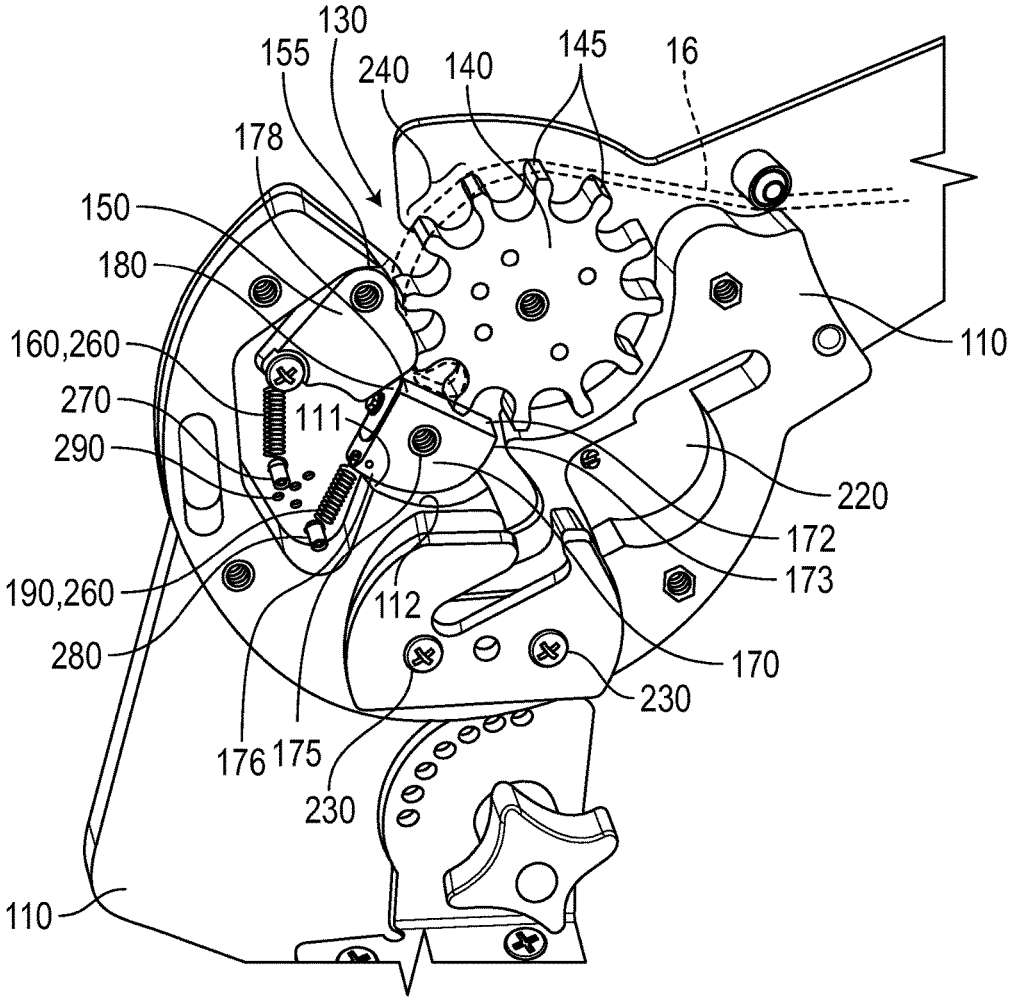
FIG. 4 is an enlarged left-side perspective view of FIG. 3.

A rigid front plate 100 is fixed with the rear plate 50 with at least one standoff 110, thereby defining a gap 120 therebetween for holding a sealing mechanism 130 (FIG. 4). The front plate 100 includes the sealing pathway 80 aligned with the sealing pathway 80 of the rear plate 50 and traversing a top side 108 of the front plate 100 and likewise terminating at an orthogonally-oriented cutting pathway 90 of the front plate 100. Preferably the front plate 100 is made from a strong metallic sheet material, but can also be made from a strong, rigid plastic or wood material.

In one embodiment, the at least one standoff 110 between the front and rear plates 100,50 defines at least one spare parts storage volume 220 sufficiently large to hold a spare tape brake 150, a spare tape cutter 170, Allen wrenches (not shown), screw drivers (not shown), springs (not shown), spare cutting blades 180, or the like. Preferably the front plate 100 and the rear plate 50 are each fixed to the at least one standoff 110 with a plurality of mechanical fasteners 230, such as screws or bolts. Alternately, the front and rear plates 100,50 are fixed to each other through the at least one standoff 110 with the plurality of mechanical fasteners 230.

The sealing mechanism 130 comprises an indexing wheel 140 rotationally captured between the front and rear plates 100,50 and having a tape engaging surface 155 urged against the indexing wheel 140 adjacent the sealing pathway 80 with a first biasing mechanism 160, such as a coil spring 260 fixed between the tape brake 150 and the rear plate 50 or a first mounting post 270 fixed between the front and rear plates 50,100. Preferably the front plate 100 and the rear plate 50 each include a plurality of cooperative mounting apertures 290 for supporting the first mounting post 270 at a plurality of adjustable positions with respect to the tape brake 150.

A tape cutter 170 is rotationally captured between the front and rear plates 100,50 at a central position 175 thereof and has a lower end 172 and a cutting blade 180 fixed with an upper end 178 thereof. A second biasing mechanism 190, such as a coil spring 260 fixed between the tape cutter 170 and the rear plate 50 or a second mounting post 280 that is fixed between the front and rear plates 100,50, urges the blade 180 away from the sealing pathway 80 and the lower end across the sealing pathway 80. Preferably the coil spring 260 is fixed to the tape cutter 170 at a set screw 261 or the like that is orthogonal to the plane of a loop of the end of the coil spring 260, so that as the tape cutter 170 rotates frequently the coil spring 260 is not physically bent or exposed to rotational forces, prolonging the life of such a coil spring 260.

A catch 173 of the rotating tape cutter 170, when the tape cutter 170 is rotated such that the blade 180 traverses the sealing pathway 80, contacts a portion 112 of the at least one standoff 110 so as to prevent over-rotation of the tape cutter 170 and inadvertent contact between the blade 180 and the indexing wheel 140, thereby reducing wear of the blade 180. Preferably the front plate 100 and the rear plate 50 each include a plurality of cooperative mounting apertures 290 for supporting the second mounting post 280 at a plurality of adjustable positions with respect to the tape cutter 170.

A back end 176 of the tape cutter 170 is adapted to contact the at least one standoff 110 at a nub 111 thereof before the lower end 172 of the tape cutter 170 rotates to contact the indexing wheel 140. This results in the tape cutter 170 being prevented from snapping back to contact the indexing wheel 140 after the object 15 passes the lower end 172 of the tape cutter 170. If the lower end 172 of the tape cutter 170 is allowed to contact the indexing wheel 140, it can force the indexing wheel 140 to rotate backwards, often disengaging the tape 16 from the tape brake 150. Various cooperative shapes of the tape cutter 170 and the nub 111 of the at least one standoff 110 may be utilized to implement this feature.

A primary advantage of the tape brake 150 of the present invention is to maintain an optimal tension on the tape 16 while it is being cut by the tape cutter 170. The tape brake 150 further forces a proper incremental rotation angle of the indexing wheel 140 due to a cooperative positive interaction between the teeth 145 of the indexing wheel 140 and the tape engaging surface 155 of the tape brake 150. Holding the tape 16 firmly between the tape engaging surface 155 and two adjacent teeth 145 of the indexing wheel 140 reduces the tape 16 recoiling upon cutting by the cutting blade 180. Further the tape 16 is held taunt while cutting, and prevents the tape 16 from prematurely advancing through the sealing pathway 80, which results in tape jams with prior art devices.

An object cutter 200 is fixable to either the front or rear plate 100,50 at the cutting pathway 90 thereof, preferably with a plurality of mechanical fasteners 230, such that both right-handed and left-handed users may configure the apparatus 10 for their use. The object cutter 200 includes a blade 210 for cutting the object 15 when the object 15 is moved through the cutting pathway 90.

Figure 5:
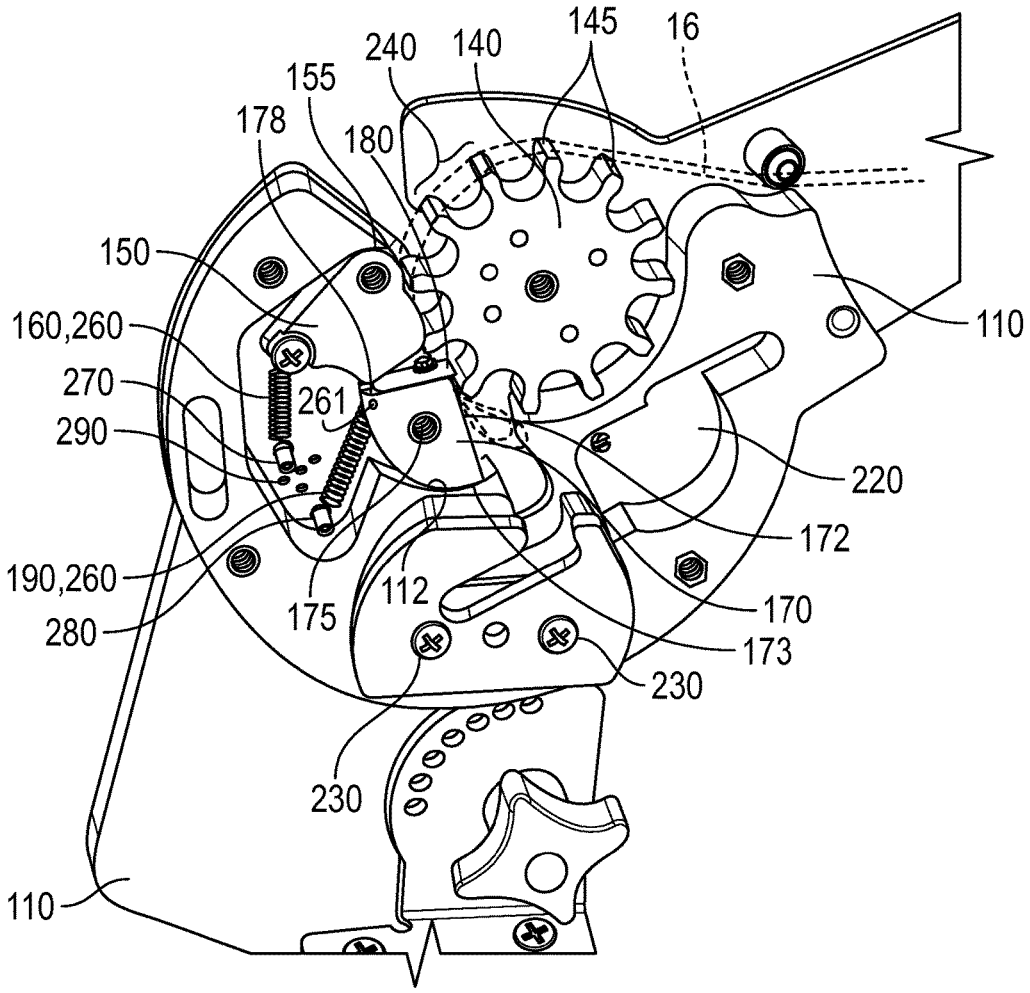
FIG. 5 is an enlarged left-side perspective view of FIG. 3, illustrated with a tape cutter in a cutting position to cut a length of adhesive tape.

In use, with the tape 16 fixed with the tape roll spindle 60 and a length of the tape 16 fixed along a top side 148 of the indexing wheel 140 and across the sealing path 80, the object 15 when forced down through the sealing path 80 receives the length of tape 16 between two of the teeth 145 of the indexing wheel 140. The tape brake 150 captures a leading edge of the tape 16 to adhere to a loop 17 of the tape 16 as the object passes the tape brake 150. Preferably the tape brake 150, when urged into contact with the indexing wheel 140, spans the gap 240 between two adjacent teeth 145 of the indexing wheel 140, such that the cut end of the tape 16 is attached to the tape brake 150. The object 15 is then sealed by the loop 17 of the tape 16 adhering to itself and passing along the tape cutter 170 that, when the object 15 contacts the lower end 172 of the tape cutter 170, rotates to force the tape cutting blade 180 across the sealing pathway 80 to cut the tape 16 (FIG. 5). The object 15 is then moved through the cutting pathway 90 to cut the object 15 with the blade 210 of the object cutter 200.

Preferably the tape brake 150, tape cutter 170, and indexing wheel 140 are mutually independent and interchangeable or replaceable by removing the front plate 100 from the at least one standoff 110.

In one embodiment, a tape alignment wheel 250 is rotationally fixed between the front and rear plates 100,50 between the indexing wheel 140 and the tape roll spindle 60. The tape alignment wheel 250 is adapted for receiving partially therearound a length of the tape 16 as it is removed from the tape roll spindle 60 and wrapped partially around the indexing wheel 140.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An apparatus for sealing an object with a one-sided adhesive tape on a support surface, comprising:

a rigid base adapted for fixing with the support surface and including a pivot aperture and a plurality of radially-spaced angle adjustment apertures;

a rigid rear plate having a second pivot aperture cooperative with a pivot pin and the pivot aperture of the base to provide pivotal movement between the rear plate and the base, the rear plate further including an adjustment pin adapted for engaging any of the angle adjustment apertures, a manual adjustment knob cooperative with the pivot pin to tighten the rear plate to the base with the adjustment pin engaged with one of the angle adjustment apertures to rotationally lock the rear plate to the base;

the rear plate further including a tape roll spindle rotationally attached at a tape roll aperture traversing the rear plate, a sealing pathway traversing a top side of the rear plate and terminating at an orthogonally-oriented cutting pathway of the rear plate;

a rigid front plate fixed with the rear plate with at least one standoff, thereby defining a gap therebetween for holding a sealing mechanism, the front plate including the sealing pathway aligned with the sealing pathway of the rear plate, traversing a top side of the front plate and terminating at an orthogonally-oriented cutting pathway of the front plate;

the sealing mechanism comprising an indexing wheel rotationally captured between the front and rear plates and having a plurality of radially-extending teeth, a plurality of the teeth extending across the sealing pathway; a tape brake rotationally captured between the front and rear plates and having a tape engaging surface urged against the indexing wheel adjacent the sealing pathway with a first biasing mechanism; a tape cutter rotationally captured between the front and rear plates at a central position thereof and having a lower end and a cutting blade fixed with an upper end, a second biasing mechanism urging the blade away from the sealing pathway and the lower end across the sealing pathway;

an object cutter fixed to either the front or rear plate at the cutting pathway thereof, the object cutter including a blade for cutting the object when the object is moved through the cutting pathway;

whereby with the tape fixed with the tape roll spindle and a length of the tape fixed along a top side of the indexing wheel and across the sealing pathway, the object when forced down through the sealing pathway receives the length of tape between two of the teeth of the indexing wheel, the tape brake capturing a leading edge of the tape to adhere to a loop of the tape as the object passes the tape brake, the object being sealed by the loop of the tape adhering to itself and passing along the tape cutter that, when the object contacts the lower end of the tape cutter, rotates to force the tape cutting blade across the sealing pathway to cut the tape, the object then being moved through the cutting pathway to cut the object with the blade of the object cutter.

2. The apparatus of claim 1 wherein the at least one standoff between the front and rear plates defines at least one spare parts storage volume.

3. The apparatus of claim 1 wherein the tape brake, tape cutter, and indexing wheel are mutually independent and replaceable by removing the front plate from the at least one standoff.

4. The apparatus of claim 1 wherein the object cutter is fixed to either the front plate or the rear plate with a pair of mechanical fasteners, whereby both right-handed and left-handed users may configure the apparatus for their use.

5. The apparatus of claim 1 wherein the tape brake when urged into contact with the indexing wheel spans the gap between two adjacent teeth of the indexing wheel, whereby the cut end of the tape is attached to the tape brake.

6. The apparatus of claim 1 wherein the front plate and the rear plate are each fixed to the at least one standoff with a plurality of mechanical fasteners.

7. The apparatus of claim 1 wherein a tape alignment wheel is rotationally fixed between the front and rear plate between the indexing wheel and the tape roll spindle, the tape alignment wheel adapted for receiving partially therearound a length of tape as it is removed from the tape roll spindle and wrapped partially around the indexing wheel.

8. The apparatus of claim 1 wherein the first biasing mechanism is a coil spring fixed between the tape brake and the rear plate.

9. The apparatus of claim 1 wherein the first biasing mechanism is a coil spring fixed between the tape brake and a first mounting post fixed between the front and rear plates.

10. The apparatus of claim 1 wherein the second biasing mechanism is a coil spring fixed between the tape cutter and the rear plate.

11. The apparatus of claim 1 wherein the second biasing mechanism is a coil spring fixed between the tape cutter and a second mounting post fixed between the front and rear plates.

12. The apparatus of claim 1 wherein the tape reel spindle further includes a tape reel ledge adapted to align the tape with the indexing wheel as the tape is removed from the tape roll spindle.

13. The apparatus of claim 9 wherein the front plate and the rear plate each include a plurality of cooperative mounting apertures for supporting the first mounting post at a plurality of adjustable positions with respect to the tape brake.

14. The apparatus of claim 11 wherein the front plate and the rear plate each include a plurality of cooperative mounting apertures for supporting the second mounting post at a plurality of adjustable positions with respect to the tape cutter.

* * * * *